US006673394B1

(12) United States Patent
Hayashi et al.

(10) Patent No.: US 6,673,394 B1
(45) Date of Patent: Jan. 6, 2004

(54) PROCESS FOR PRODUCING PRINTED ARTICLES

(75) Inventors: Tsuyoshi Hayashi, Tokyo (JP); Tatsuo Kawamura, Tokyo (JP); Toshio Ishimizu, Tokyo (JP)

(73) Assignee: Dainichiseika Color & Chemicals Mfg. Co., Ltd., Tokyo (JP)

( * ) Notice: Subject to any disclaimer, the term of this patent is extended or adjusted under 35 U.S.C. 154(b) by 0 days.

(21) Appl. No.: 09/624,345

(22) Filed: Jul. 24, 2000

(30) Foreign Application Priority Data

Jul. 23, 1999 (JP) ..... 11-209867

(51) Int. Cl.[7] ..... B05D 1/36; B05D 7/00

(52) U.S. Cl. ..... 427/265; 427/261; 427/288; 427/373; 427/389.9; 427/412

(58) Field of Search ..... 427/261, 265, 427/288, 373, 389.9, 412

(56) References Cited

U.S. PATENT DOCUMENTS 4,162,342 A * 7/1979 Schwartz ..... 156/78
4,341,832 A * 7/1982 Barnett et al. ..... 427/210
5,089,296 A * 2/1992 Bafford et al. ..... 427/208
5,460,873 A * 10/1995 Ogawa et al. ..... 427/369

FOREIGN PATENT DOCUMENTS

| | | | |
|---|---|---|---|
| DE | DT2540288 | A1 | 3/1976 |
| DE | DT2617144 | A1 | 11/1977 |
| EP | 0014890 | A2 | 9/1980 |
| EP | 0108931 | A1 | 5/1984 |
| GB | 1539467 | | 1/1979 |
| GB | 1 539 467 | | 1/1979 |

* cited by examiner

*Primary Examiner*—Shrive P. Beck
*Assistant Examiner*—Kirsten Crockford Jolley
(74) *Attorney, Agent, or Firm*—Young & Thompson

(57) ABSTRACT

A process for producing printed articles which comprises forming an under coat on a cloth having a rough surface with a foamed composition of a resin emulsion by printing, drying the formed under coat, forming a top coat on the dried under coat by printing and drying the formed top coat. In accordance with the process, cloths having a rough surface such as frieze cloths, pile cloths, knit cloths, towel cloths, felt cloths and blanket cloths can be printed while the proper feel of the cloth is maintained and printed articles having excellent fastness and appearance are obtained.

20 Claims, 1 Drawing Sheet

PROCESS FOR PRODUCING PRINTED ARTICLES

BACKGROUND OF THE INVENTION

1. Field of the Invention

The present invention relates to a process for producing printed articles. More particularly, the present invention relates to a process for producing printed articles which enables printing cloths having a rough surface such as frieze cloths, pile cloths, knit cloths, towel cloths, felt cloths and blanket cloths while the proper feel of the cloth is maintained and provides printed articles having excellent fastness and appearance.

2. Description of Related Art

As a greater variety of fiber products are produced and the products become more fashionable in recent years, it is required that printed articles be made from cloths having a rough surface such as raised frieze cloths, flocked pile cloths, bulky knit cloths, towel cloths, felt cloths and blanket cloths.

However, when such a cloth having a rough surface is printed in accordance with a conventional process such as pigment printing and printing using a rubber printing material, problems arise, for example, in that, due to the rough structure of the surface, pigments are attached to depressed portions in a greater amount to deteriorate the feel of the cloth or only to tip portions of raised fibers and clothing articles having poor appearance and poor patterns are obtained. When the entire surface of a cloth is laminated with a film or coated with a soft resin to smooth the rough surface of a cloth, the properties of the cloth is markedly deteriorated. Therefore, the one-point printing is rarely conducted in printing a cloth having a rough surface. When a cloth having a rough surface is printed, it is necessary that a process such as the film transfer printing and a process using a print flocky be used.

Therefore, a process which enables direct printing on cloths having a rough surface while the proper feel of the cloths is maintained, provides printed articles exhibiting excellent fastness and appearance and can produce printed articles rapidly even when many types of printed articles are produced in small quantities has been required.

SUMMARY OF THE INVENTION

An object of the present invention is to provide a process for producing printed articles which enables printing cloths having a rough surface such as frieze cloths, pile cloths, knit cloths, towel cloths, felt cloths and blanket cloths while the proper feel of the cloths is maintained and provides printed articles having excellent fastness and appearance.

As the result of intensive studies by the present inventors to overcome the above problems, it was found that, when an under coat is formed on a cloth having a rough surface with a foamed composition of a resin emulsion by printing and a top coat is formed on the formed under coat by printing, the proper feel of the cloth is not adversely affected even when the cloth is directly printed and a printed article exhibiting excellent fastness and appearance can be produced. The present invention has been completed based on this knowledge.

The present invention provides:

(1) A process for producing printed articles which comprises forming an under coat on a cloth having a rough surface with a foamed composition of a resin emulsion by printing, drying the formed under coat, forming a top coat on the dried under coat by printing and drying the formed top coat;

(2) A process described in (1) wherein the composition of a resin emulsion is an emulsion of an acrylic ester resin;

(3) A process described in (2) wherein the acrylic ester resin has a glass transition temperature of −40 to 20° C.;

(4) A process described in (1) wherein the composition of a resin emulsion comprises foaming agents, foam stabilizers and thickeners;

(5) A process described in (1) wherein the foamed composition of a resin emulsion has an extent of foaming of 1.2 to 4 times;

(6) A process described in (1) wherein the top coat is formed by pigment printing, rubber printing or printing with foaming by heating;

(7) A process described in (1) wherein the top coat which has been formed by printing and dried is heat treated; and (8) A process described in (1) wherein the cloth having a rough surface is a frieze cloth, a pile cloth, a knit cloth or a towel cloth.

Figure 1A:
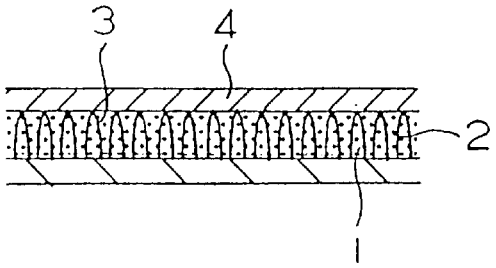
FIG. 1(*a*), FIG. 1(*b*), FIG. 1(*c*), FIG. 1(*d*), FIG. 1(*e*) and FIG. 1(*f*) show diagrams describing the process for producing printed articles of the present invention.
Figure 1B:
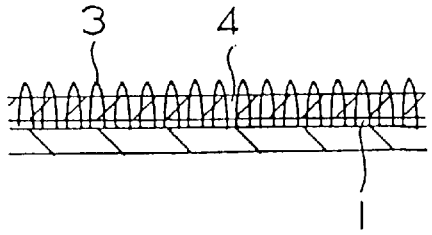
Figure 1C:
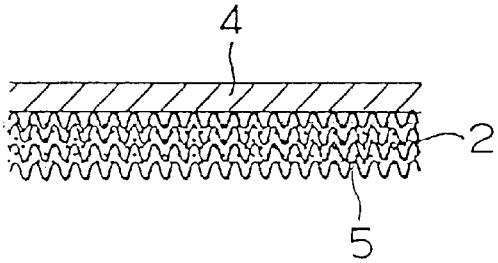
Figure 1D:
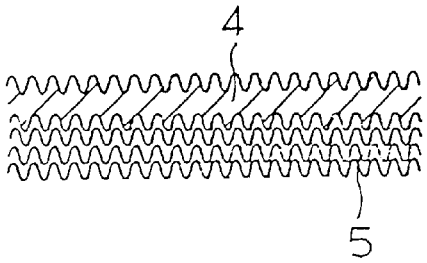
Figure 1E:
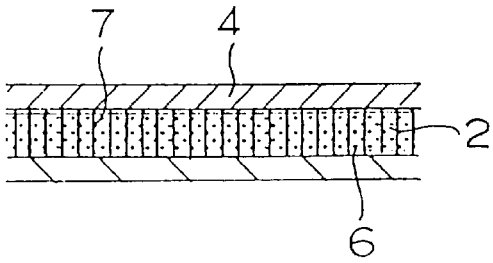
Figure 1F:
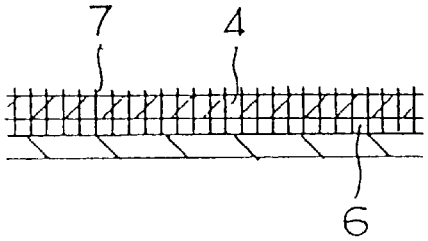

The numbers in FIG. 1 mean as listed in the following:

1: A towel cloth
2: A composition of a resin emulsion
3: A loop
4: A top coat
5: A knit cloth
6: A pile cloth
7: A raised fiber

DESCRIPTION OF THE PREFERRED EMBODIMENTS

The process of the present invention comprises forming an under coat on a cloth having a rough surface with a foamed composition of a resin emulsion by printing, drying the formed under coat, forming a top coat on the dried under coat by printing and drying the formed top coat. The process of the present invention can be advantageously applied to cloths having a marked roughness on the surface such as raised frieze cloths, flocked pile cloths, bulky knit cloths, towel cloths, felt cloths and blanket cloths.

The resin emulsion used in the present invention is not particularly limited. Examples of the resin emulsion include natural rubber lattices, synthetic rubber lattices, emulsions of acrylic ester resins, emulsions of vinyl acetate resins, emulsions of ethylene-vinyl acetate copolymers, emulsions of vinyl chloride resins and emulsions of polyurethane resins. The resin emulsions may be used singly or in combination of two or more. Among the above resin emulsions, emulsions of acrylic ester resins are preferably used because an under coat having a soft feel can be made. It is preferable that the resin in the resin emulsion has a glass transition temperature of −40 to 20° C. and more preferably −30 to 0° C. When the glass transition temperature of the resin is lower than −40° C., there is the possibility that workability is poor in application of the top coat on the under coat. When the glass transition temperature exceeds 20° C., there is the possibility that the feel becomes hard. It is preferable that the resin emulsion has a solid content of 30 to 70% by weight and more preferably 40 to 60% by weight. When the solid content is less than 30% by weight or exceeds 70% by weight, there is the possibility that workability is poor in forming the under coat.

The composition of a resin emulsion used in the present invention is not particularly limited. For example, the composition of a resin emulsion can be prepared by mixing foaming agents, foam stabilizers, crosslinking agents, thickeners and coloring agents with the resin emulsion. Examples of the foaming agent and the foam stabilizer include surfactants such as sodium lauryl sulfate, ammonium stearate and fatty acid diethanolamides. By using the foaming agent and the foam stabilizer in the composition, fine foams can be formed in the resin emulsion in the foaming step and an under coat having an excellent feel can be formed accurately and easily on a cloth by printing. Examples of the crosslinking agent include carbodiimide crosslinking agents, isocyanate crosslinking agents, oxazoline crosslinking agents and ethyleneimine crosslinking agents. By using the crosslinking agent in the composition, the resin in the formed under coat is crosslinked and fastness of the under coat can be improved. Examples of the thickener include polyacrylic acid which is effective in an alkaline condition, nonionic thickeners such as polyethylene glycol distearate and polyurethane thickeners. By using the thickener in the composition, viscosity of the composition of a resin emulsion is increased and workability can be improved in foaming and in the formation of the under coat. As the coloring agent, pigments and dyes of desired colors can be used.

In the process of the present invention, the composition of a resin emulsion for the under coat is foamed. The method of foaming the composition of a resin emulsion is not particularly limited. It is preferable that a foaming machine having the foaming mechanism in which the air is blown into the composition while the composition is stirred is used. It is preferable that the resin emulsion, the foaming agent, the foam stabilizer, the crosslinking agent, the thickener and the coloring agent are placed together and the components are mixed uniformly by preliminarily mixing at a low speed, foamed by stirring at a high speed and then stirred at a low speed to adjust the product into a desired condition. The extent of foaming in the foaming step is not particularly limited. It is preferable that the foaming is conducted in a manner such that the volume of the foamed composition of a resin emulsion is 1.2 to 4 times as large as that of the composition of a resin emulsion before foaming. When the extent of foaming described above is less than 1.2 times, there is the possibility that the under coat becomes hard and the feel deteriorates. When the extent of foaming exceeds 4 times, there is the possibility that the formed under coat does not have a flat and smooth surface and the top coat is not formed in an excellent condition.

In the present invention, the method of forming the under coat with the foamed composition of a resin emulsion by printing is not particularly limited. It is preferable that the under coat is formed by printing using a silk screen. The thickness of the silk screen is not particularly limited. It is preferable that the thickness is 25 to 500 $\mu$m and more preferably 100 to 300 $\mu$m. When the thickness of the screen is smaller than 25 $\mu$m, there is the possibility that the formed under coat does not have a flat and smooth surface and the top coat is not formed in an excellent condition. When the thickness of the screen exceeds 500 $\mu$m, there is the possibility that the under coat is excessively thick and the feel deteriorates. When the foamed composition of a resin emulsion is applied to a cloth by printing as the under coat, the lower the viscosity of the foamed composition of a resin emulsion, the better the adhesion with the cloth. In the formation of the under coat by printing, the under coat having an excellent adhesive property can be formed by conducting the first stoke of the printing under an added pressure so that the composition penetrates into the cloth. It is preferable that the under coat has the same pattern as that of the top coat which is the pattern formed on the produced article. After the under coat is formed by printing, a flat surface for forming the top coat by printing can be formed on the rough surface of a cloth by drying the formed under coat and, where necessary, heat treating the under coat to fix the bulky shape of the foam.

In the present invention, the top coat is formed by printing on the cloth having a rough surface on which the under coat has been formed. The top coat formed by printing is not particularly limited. For example, the top coat may be a layer formed by the pigment printing, the rubber printing or the printing with foaming by heating. The pigment printing, the rubber printing and the printing with foaming by heating may be conducted singly or in combination of two or more. It is preferable that the top coat has the same pattern as that on the under coat and the pattern is laid on the pattern of the under coat. When the top coat is formed by printing on the under coat and the coated cloth is removed from the printing plate while the printed cloth is still wet, the printed portion is deformed. Therefore, it is preferable that the printed cloth is sufficiently dried. By forming the top coat on the under coat by printing, penetration of the printing paste for printing a pattern and the resin of rubber printing into the cloth can be prevented and a printed article having an excellent feel can be obtained. In the present invention, it is preferable that, after the top coat is formed by printing, the printed cloth is preliminarily dried sufficiently, heat treated and then heat pressed. Fastness may be occasionally affected by the thickness of the cloth since the heat efficiency is different depending on the thickness of the cloth. By further heat pressing the printed portion, a printed article which is flat, smooth and soft can be obtained.

FIG. 1(*a*), FIG. 1(*b*), FIG. 1(*c*), FIG. 1(*d*), FIG. 1(*e*) and FIG. 1(*f*) show diagrams describing the process for producing printed articles of the present invention. FIG. 1(*a*) shows a diagram describing the case in which the process of the present invention is applied to a towel cloth. A foamed composition of a resin emulsion 2 disposed on a towel cloth 1 by printing forms a flat plane over tips of loops 3 without changing the feel brought about by the loops 3 and a top coat 4 can be formed on this layer by printing. In FIG. 1(*b*), a layer corresponding to the top coat is formed without forming a layer of a foamed composition of a resin emulsion by printing. Loops 3 are adhered to each other due to the formed top coat and fall down to the surface of the cloth by the pressure. Therefore, this article has an inferior feel. FIG. 1(*c*) shows a diagram describing the case in which the process of the present invention is applied to a knit cloth. A foamed composition of a resin emulsion 2 disposed on knit cloth 5 by printing forms a flat plane on the surface of the knit cloth without adversely affecting the feel of the knit cloth and a top coat 4 can be formed on this layer by printing. In FIG. 1(*d*), a layer corresponding to the top coat is formed without forming a layer of a foamed composition of a resin emulsion by printing. The layer formed by printing is depressed at portions corresponding to gaps in the knit cloth and the appearance of the printed article deteriorates. FIG. 1(*e*) shows a diagram describing the case in which the process of the present invention is applied to a pile cloth. A foamed composition of a resin emulsion 2 disposed on a pile cloth 6 by printing forms a flat plane over tips of raised fibers on the surface of the knit cloth without changing the feel of the knit cloth brought about by the raised fibers 7 and a top coat 4 can be formed on this layer by printing. In FIG. 1(*f*), a layer corresponding to the top coat is formed without forming a layer of a foamed composition of a resin emulsion by printing. When the raised fibers are placed thinly, the raised fibers are adhered to each other due to the formed top coat and the raised fibers fall down to the surface of the cloth by the pressure. Therefore, this article has an inferior feel. When the raised fibers are placed densely, the layer formed by printing is present only at portions around tips of the raised fibers. Therefore, when a tensile force is applied to the cloth, the layer formed by printing is broken and the material under the layer is exposed to the outside.

In accordance with the process of the present invention, cloths having a rough surface such as frieze cloths, pile cloths, knit cloths, towel cloths, felt cloths and blanket cloths can be directly printed while the proper feel of the cloth is maintained and printed articles having excellent fastness and appearance can be obtained. In accordance with the process of the present invention, the printing property of a printing material such as the rubber printing material which is used for the top coat is improved, printed articles can be produced rapidly even when many types of printed articles are produced in small quantities and printed articles having the feel which is more excellent than that obtained by the film transfer process can be obtained.

To summarize the advantages obtained by the present invention, In accordance with the process, cloths having a rough surface such as frieze cloths, pile cloths, knit cloths, towel cloths, felt cloths and blanket cloths can be printed while the proper feel of the cloth is maintained and printed articles having excellent fastness and appearance are obtained.

EXAMPLES

The present invention will be described more specifically with reference to examples in the following. However, the present invention is not limited to the examples.

Example 1

A resin emulsion [manufactured by DAINICHI-SEIKA COLOR AND CHEMICALS MFG. Co.; Ltd., SEIKARESIN MF-P; an emulsion of a butyl acrylate-methyl acrylate copolymer; the solid content: 50% by weight; the glass transition temperature of the resin: −30° C.] in an amount of 100 parts by weight, 5 parts by weight of a coloring pigment [manufactured by DAINICHI-SEIKA COLOR AND CHEMICALS MFG. Co., Ltd.; EP677 WHITE (modified), white], 5 parts by weight of a foam stabilizer [manufactured by DAINICHI-SEIKA COLOR AND CHEMICALS MFG. Co., Ltd.; EFFECTAR MF; an anionic surfactant] and 5 parts by weight of a crosslinking agent [manufactured by DAINICHI-SEIKA COLOR AND CHEMICALS MFG. Co., Ltd.; EMAFIX DH; an oxazoline crosslinking agent] were mixed together. Viscosity of the obtained mixture was adjusted to 20,000 cps by adding a thickener [manufactured by DAINICHI-SEIKA COLOR AND CHEMICALS MFG. Co., Ltd.; EFFECTAR HV-2] and a composition of a resin emulsion was obtained.

The obtained composition of a resin emulsion was foamed by a foaming machine for the household use in a manner such that the volume after the foaming was 2.0 times the volume before the foaming. The foamed composition of a resin emulsion was applied to a raised frieze cloth using a 50 mesh screen having a thickness of 300 $\mu$m by printing and the formed under coat was dried at 110° C. for 2 minutes.

To 100 parts of a rubber printing material [manufactured by DAINICHI-SEIKA COLOR AND CHEMICALS MFG. Co., Ltd.; SEIKATOP MX-10], 3 parts by weight of a color base [manufactured by DAINICHI-SEIKA COLOR AND CHEMICALS MFG. Co., Ltd.; BLUE FL2B CONC; blue] was added. The obtained printing material was applied by printing to the above cloth having the under coat using a 80 mesh screen in a manner such that the pattern is placed on the same position as that of the pattern on the under coat. The layer obtained by the printing was heat treated at 150° C. for 2 minutes.

The printed article thus obtained had a pattern with clear peripheral portions and a very flexible feel. The printed article was tested with respect to the fastness in washing and fastness against wear in accordance with Japanese Industrial Standard L0844, L0849 and L0217 (Method 103 for practical washing). No portions of the coloring agents or printed films were detached and the result was as excellent as that obtained by using conventional rubber printing materials.

Example 2

A resin emulsion [a mixture of an emulsion of butyl acrylate copolymer and an emulsion of an ethylene-vinyl acetate resin in the same amounts; the solid content: 55% by weight] in an amount of 100 parts by weight, 20 parts by weight of aluminum hydroxide, 5 parts by weight of titanium oxide, 5 parts by weight of a foam stabilizer [manufactured by DAINICHI-SEIKA COLOR AND CHEMICALS MFG. Co., Ltd.; EFFECTAR MF; an anionic surfactant], 5 parts by weight of a crosslinking agent [manufactured by DAINICHI-SEIKA COLOR AND CHEMICALS MFG. Co., Ltd.; EMAFIX DH; an oxazoline crosslinking agent] and 10 parts by weight of water were mixed together and a composition of a resin emulsion was obtained.

The obtained composition of a resin emulsion was foamed by a foaming machine for the household use in a manner such that the volume after the foaming was 3.0 times the volume before the foaming. The foamed composition of a resin emulsion was applied to a smooth knit cloth having a coarse network using a 50 mesh screen having a thickness of 300 $\mu$m by printing and the formed under coat was dried at 110° C. for 2 minutes.

To 100 parts of a rubber printing material [manufactured by DAINICHI-SEIKA COLOR AND CHEMICALS MFG. Co., Ltd.; SEIKATOP MX-10], 5 parts by weight of a color base [manufactured by DAINICHI-SEIKA COLOR AND CHEMICALS MFG. Co., Ltd.; BLUE FL2B CONC; blue] was added. The obtained printing material was applied by printing to the above cloth having the under coat using a 80 mesh screen in a manner such that the pattern is placed on the same position as that of the pattern on the under coat. The layer obtained by the printing was heat treated at 150° C. for 2 minutes.

The surface of the under coat formed with the foamed composition of a resin emulsion was porous and the rubber printing material could be applied smoothly. Thus, an article having a very excellent appearance could be obtained.

Comparative Example 1

A knit cloth having a coarse network which was the same as that used in Example 2 was coated twice by printing with the mixture of a rubber printing material and a color base prepared in Example 2.

In the first printing, attachment of the mixture of a rubber printing material and a color base to the surface of the cloth was insufficient and the mixture of a rubber printing material and a color base was repelled from the surface in the second printing. The obtained article had poor appearance and a defective pattern.

What is claimed is:

1. A process for producing printed articles made of cloth comprising a knit cloth or a cloth having raised fibers or loops, which comprises forming a foamed composition of a resin emulsion, disposing said composition on the cloth by printing in a manner such that the foamed composition forms a flat plane on the surface of the tips of raised fibers or loops on the surface of the cloth thereby to produce an undercoat, drying the undercoat, forming a top coat on the dried undercoat by printing, and drying the top coat, wherein said undercoat is formed by printing using a silk screen having a thickness of 25 to 500 $\mu$m; said printing being accomplished by conducting the first stroke of the printing under an added pressure so that the composition penetrates into the cloth.

2. A process as claimed in claim 1, wherein said emulsion is an emulsion of an acrylic ester resin.

3. A process as claimed in claim 2, wherein the acrylic ester resin has a glass transition temperature of −40 to 20° C.

4. A process for producing printed articles according to claim 2, wherein the acrylic ester resin is a butyl acrylate-methyl acrylate copolymer.

5. A process as claimed in claim 1, wherein said foamed composition has an extent of foaming of 1.2 to 4 times.

6. A process as claimed in claim 1, wherein the foamed composition is formed by mechanical foaming.

7. A process as claimed in claim 1, wherein said cloth is a frieze cloth, a pile cloth, a knit cloth, a blanket cloth or a towel cloth.

8. A process as claimed in claim 1, wherein said emulsion is an emulsion of an acrylic ester resin having a glass transition temperature of −40 to 20° C., said foamed composition has an extent of foaming of 1.2 to 4 times.

9. A process for producing printed articles according to claim 1, wherein the resin emulsion is a mixture of an emulsion of butyl acrylate copolymer and an emulsion of an ethylene-vinyl acetate resin.

10. The process as claimed in claim 1, wherein said undercoat has a flat exposed surface and said top coat is printed on said exposed surface of said undercoat.

11. A process for producing printed articles made of cloth comprising a knit cloth or cloth having raised fibers or loops, which comprises forming a foamed composition of a resin emulsion, disposing said composition on the cloth by printing in a manner such that the foamed composition forms a flat plane on the surface of the tips of raised fibers or loops on the surface of the cloth thereby to produce an undercoat, drying the undercoat, forming a top coat on the dried undercoat by printing, and drying the top coat, wherein said undercoat has the same pattern as that of the top coat which is the pattern formed on the produced article.

12. A process as claimed in claim 11, wherein said emulsion is an emulsion of an acrylic ester resin.

13. A process as claimed in claim 12, wherein the acrylic ester has a glass transition temperature of −40 to 20° C.

14. A process as claimed in claim 11, wherein said foamed composition has an extent of foaming of 1.2 to 4 times.

15. A process as claimed in claim 11, wherein the foamed composition is formed by mechanical foaming.

16. A process as claimed in claim 11, wherein said cloth is a frieze cloth, a pile cloth, a knit cloth, a blanket cloth or a towel cloth.

17. A process as claimed in claim 11, wherein said emulsion is an emulsion of an acrylic ester resin having a glass transition temperature of −40 to 20° C. and said foamed composition has an extent of foaming of 1.2 to 4 times.

18. A process for producing printed articles according to claim 11, wherein the resin emulsion is a mixture of an emulsion of butyl acrylate copolymer and an emulsion of an ethylene-vinyl acetate resin.

19. The process as claimed in claim 11, wherein said undercoat has a flat exposed surface and said top coat is printed on said exposed surface of said undercoat.

20. A process as claimed in claim 11, wherein said undercoat is formed by printing using a silk screen having a thickness of 25 to 500 $\mu$m; said printing being accomplished by conducting the first stroke of the printing under an added pressure so that the composition penetrates into the cloth.

* * * * *